US007465185B2

(12) United States Patent
Tyler

(10) Patent No.: US 7,465,185 B2
(45) Date of Patent: Dec. 16, 2008

(54) ELECTRICAL CONNECTOR ASSEMBLY WITH MATE-ASSIST AND A WIRE DRESS COVER

(75) Inventor: Adam P. Tyler, Rochester Hills, MI (US)

(73) Assignee: FCI Americas Technology, Inc, Carson City, NV (US)

( * ) Notice: Subject to any disclaimer, the term of this patent is extended or adjusted under 35 U.S.C. 154(b) by 144 days.

(21) Appl. No.: 11/395,466

(22) Filed: Mar. 30, 2006

(65) Prior Publication Data

US 2007/0232140 A1 Oct. 4, 2007

(51) Int. Cl.
*H01R 13/62* (2006.01)

(52) U.S. Cl. ..... 439/467; 439/352; 439/473

(58) Field of Classification Search ..... 439/467, 439/468, 35, 473, 350, 352
See application file for complete search history.

(56) References Cited

U.S. PATENT DOCUMENTS 4,413,872 A * 11/1983 Rudy et al. ..... 439/467
6,383,015 B2 * 5/2002 Mochizuki et al. ..... 439/492
6,641,423 B1 * 11/2003 Giro ..... 439/347
6,899,554 B1 5/2005 Osada ..... 439/157
6,971,894 B2 12/2005 Dillon et al. ..... 439/157
7,014,498 B1 * 3/2006 Munoz ..... 439/473
7,114,984 B2 * 10/2006 Shirk et al. ..... 439/372
7,204,712 B2 * 4/2007 Schwiebert et al. ..... 439/352
2002/0086575 A1 * 7/2002 Marpoe et al. ..... 439/352
2003/0096527 A1 5/2003 Greiner ..... 439/352
2003/0143886 A1 * 7/2003 Nemoto ..... 439/352
2004/0219819 A1 * 11/2004 Di Mascio ..... 439/352
2005/0003696 A1 * 1/2005 Shirk et al. ..... 439/352

OTHER PUBLICATIONS

"47-Way ABS Connector", FCI USA, Inc., 1 page.

* cited by examiner

*Primary Examiner*—Hien Vu
(74) *Attorney, Agent, or Firm*—Harrington & Smith, PC

(57) ABSTRACT

An electrical connector adapted to mate with a mating connector is provided. The electrical connector includes a housing; a wire dress cover pivotally connected to the housing; and a slide latch pivotally connected to the wire dress cover and slideably connected to the housing. The slide latch has a front end with a hole for snap lock connecting to a lock ramp on the mating connector. The housing includes at least one ramp for moving the front end of the slide latch relative to the lock ramp in response to the slide latch being slid relative to the housing.

20 Claims, 13 Drawing Sheets

ELECTRICAL CONNECTOR ASSEMBLY WITH MATE-ASSIST AND A WIRE DRESS COVER

BACKGROUND OF THE INVENTION

1. Field of the Invention

The present invention relates to an electrical connector and, more particularly, to an electrical connector with a slide latch.

2. Brief Description of Prior Developments

Electrical connector assemblies utilized in automotive and other applications often comprise separate connectors that mate together to form a secure physical and electrical connection. To achieve this, the separate connectors must not only form an effective, properly aligned electrical connection, but the separate connectors must physically connect to avoid unwanted separation and undesired application of external physical forces to the electrical coupling. In addition, during mating, high mating forces may be required to form the secure connection. However, care must be taken to avoid damage to the connectors or terminals.

Conventional electrical connector assemblies often employ cams, slides, levers and a variety of mechanical devices to aid operators in joining the connectors. These mate-assist devices are often designed to make the connector mating operation more ergonomically manageable for an operator by reducing the manual forces.

Some of the mechanical devices employed in this manner are designed to work with preexisting connector designs. Thus, a newly designed connector may securely attach to a preexisting, or pre-installed, mating connector.

SUMMARY OF THE INVENTION

In accordance with one aspect of the invention, an electrical connector adapted to mate with a mating connector is provided. The electrical connector includes a housing; a wire dress cover pivotally connected to the housing; and a slide latch pivotally connected to the wire dress cover and slideably connected to the housing. The slide latch has a front end with a hole for snap lock connecting to a lock ramp on the mating connector. The housing includes at least one ramp for moving the front end of the slide latch relative to the lock ramp in response to the slide latch being slid relative to the housing.

In accordance with another aspect of the invention, an electrical connector adapted to mate with a mating connector is provided. The electrical connector includes a housing; a wire dress cover pivotally connected to the housing; and a slide latch pivotally connected to the wire dress cover and slideably connected to the housing. The housing includes a shelf and the slide latch includes at least one latch tab for engaging the shelf.

In a further aspect of the invention, an electrical connector adapted to mate with a mating connector is provided. The electrical connector includes a housing; a wire dress cover pivotally connected to the housing; and a slide latch pivotally connected to the wire dress cover and slideably connected to the housing. The slide latch has at least one disconnection rail for engaging a front portion of the mating connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
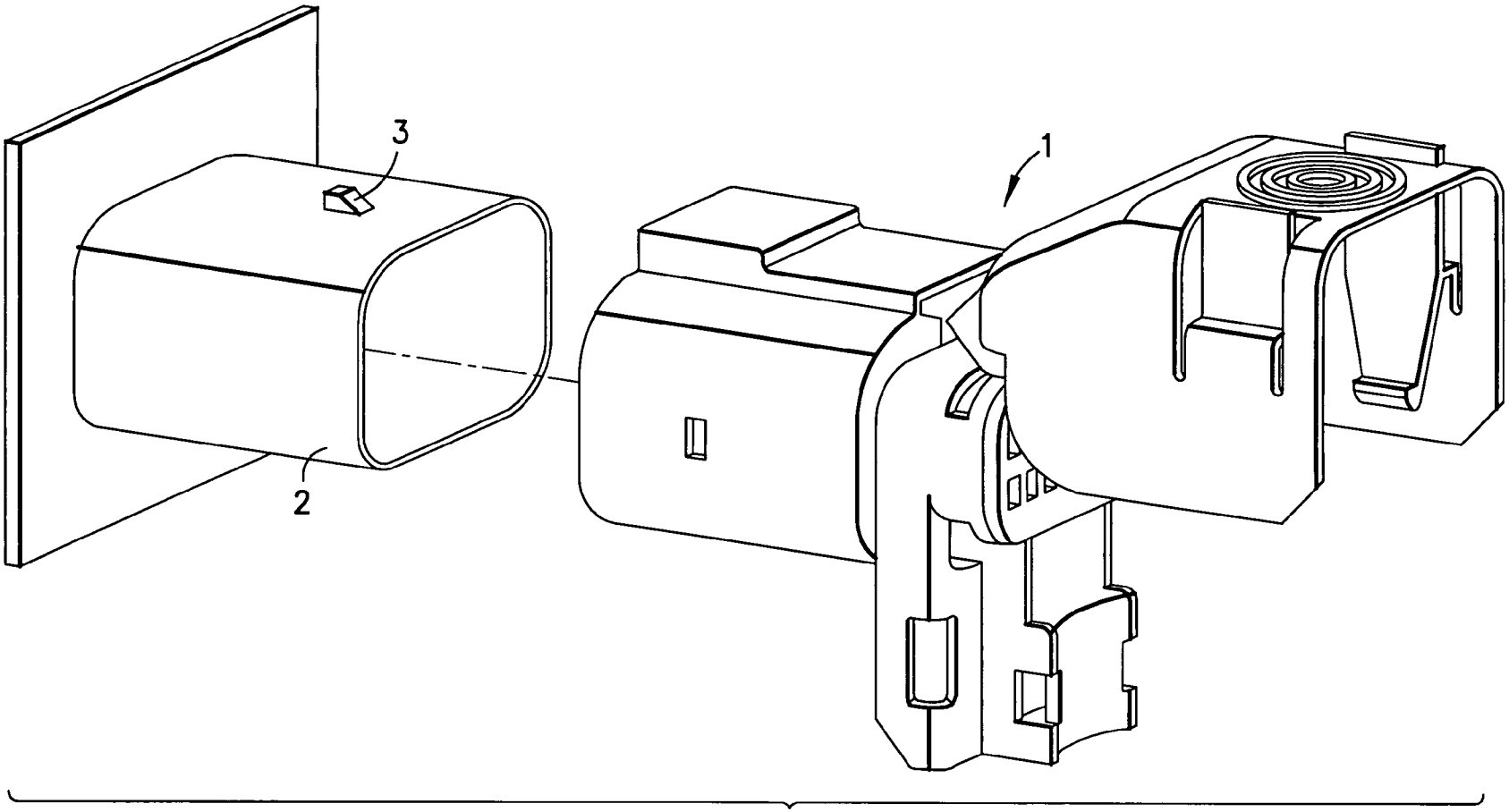
FIG. 1 is a perspective view of a 90° wire dress automotive harness connector incorporating aspects of the invention and a male mating header connector.

Referring to FIG. 1, there is shown a perspective view of an electrical connector 1 incorporating features of the present invention and a mating electrical connector 2. Although the present invention will be described with reference to the exemplary embodiment shown in the drawings, it should be understood that the present invention can be embodied in many alternate forms of embodiments. In addition, any suitable size, shape or type of elements or materials could be used.

The teachings in accord with the exemplary embodiment of this invention provide an electrical connector enabled to couple with an existing mating connector that comprises one or more lock ramps. The internal slide latch component creates a mate-assist device to reduce overall connector mating force. The electrical connector is simple to tool for molding and assembly and comprises ergonomic actuation surfaces. Electrical connectors in accord with this invention can be packaged tightly side-by-side on multi-bay header connectors.

The connector 1 in the embodiment shown is a 90° wire dress automotive harness connector. In an alternate embodiment, features of the present invention could be used in any suitable type of electrical connector including, for example, an electrical connector for use other than in the automotive industry, or a connector other than a right angle or 90° connector. The mating connector 2 is male mating header connector. However, in an alternative embodiment, any suitable mating connector could be used.

In accordance with the invention, the connector 1 is designed to enable a secure electrical and physical connection with the mating connector 2. The mating header connector 2 comprises a lock ramp 3. The mate-assist feature of the connector 1 engages the lock ramp to connect the two connectors 1, 2 to each other. The mate-assist feature of the connector 1 reduces the overall connector mating force while ensuring a physical connection that protects the electrical connection from external physical forces.

Figure 2:
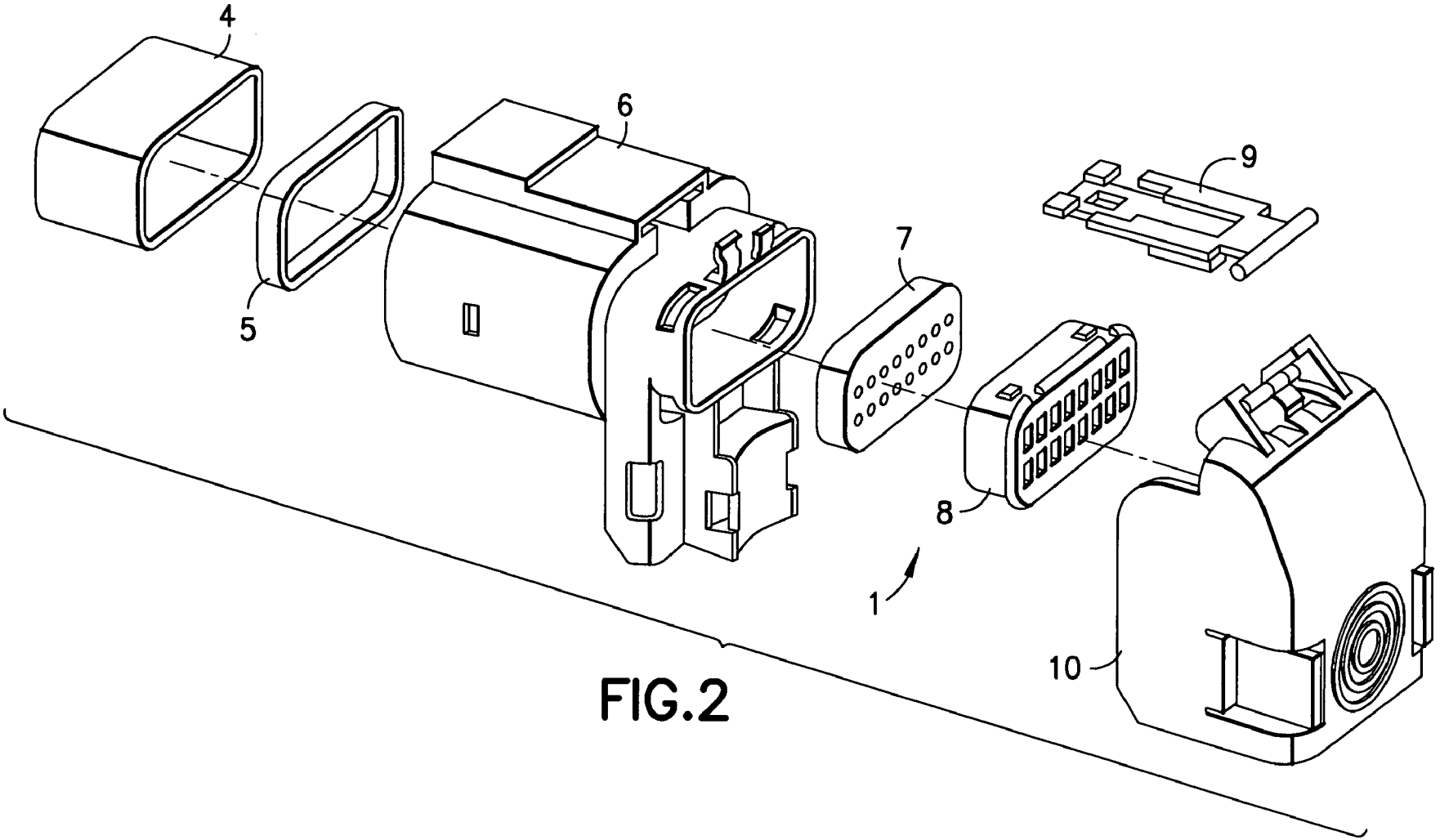
FIGS. 2 and 3 are exploded perspective views of the automotive harness connector shown in FIG. 1.
Figure 3:
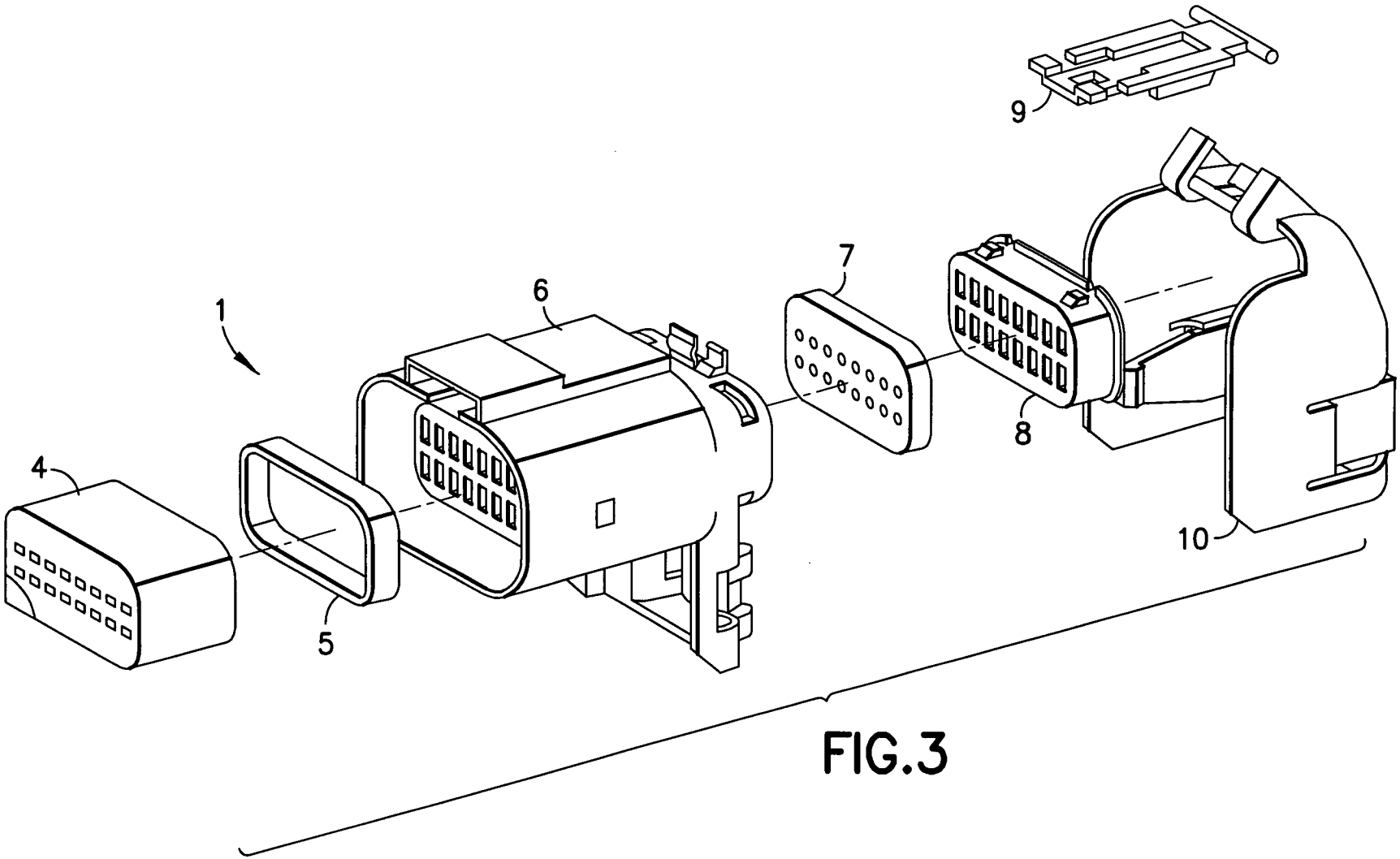

FIGS. 2 and 3 are exploded perspective views of the connector 1 shown in FIG. 1. The connector 1 generally comprises a terminal position assurance device (TPA) 4, a perimeter seal 5, a harness connector housing 6, a mat seal 7, a mat seal cover 8, a slide latch 9, and a wire dress cover 10. In alternate embodiments, additional or alternative members could be provided. The TPA 4 and perimeter seal 5 are located inside a front portion of the harness connector housing 6. The mat seal 7 and mat seal cover 8 are located inside a rear portion of the harness connector housing 6. The slide latch 9 is located inside a latch bridge 11 (shown in FIGS. 4 and 5) on a top portion of the harness connector housing 6. The wire dress cover 10 is connected to the rear portion of the harness connector housing 6 and a rear portion of the slide latch 9 as explained below.

Figure 5:
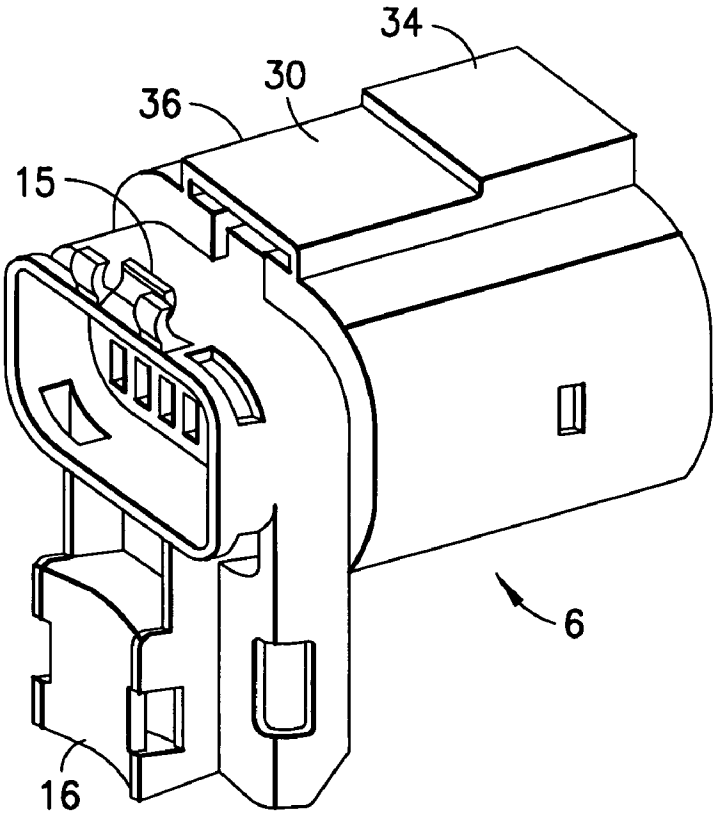
FIG. 5 is a rear perspective view of the harness connector housing shown in FIGS. 2 and 3.
Figure 4:
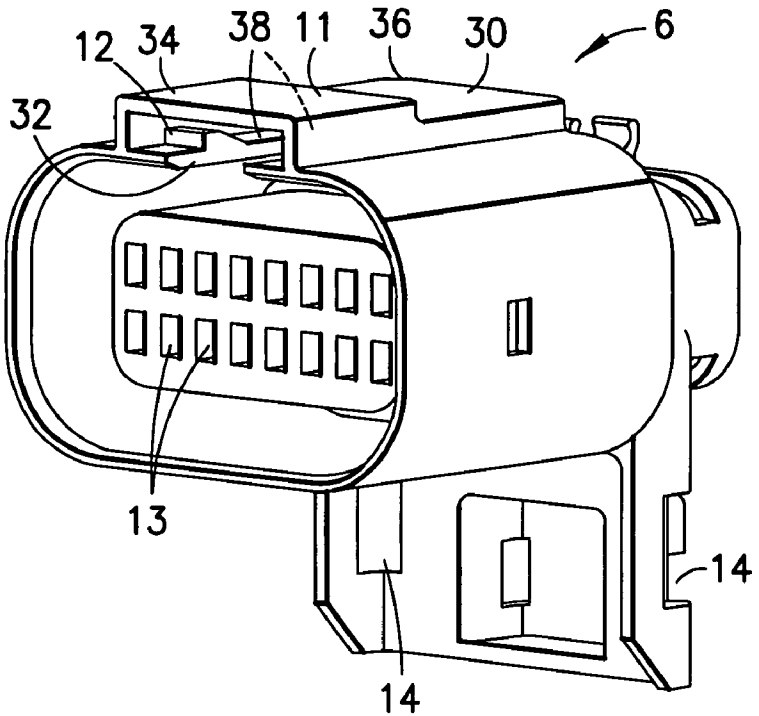
FIG. 4 is a front perspective view of the harness connector housing shown in FIGS. 2 and 3.

Referring also to FIGS. 4 and 5, the housing 6 generally comprises a latch bridge 11, slide latch ramps 12 under the latch bridge 11, terminal cavities 13, wire dress cover latch openings 14, wire dress cover pivot snaps 15, and a wire dress surface 16. Electrical contacts or terminals are located in the terminal cavities 13. Electrical wires are connected to the terminals. The wires exit from the rear end of the housing 6 and turn downward. A cable cover surrounding the wires can be located against the wire dress surface 16. The TPA 4 is connected to the housing 6 to prevent the terminals from being inadvertently pulled out of the terminal cavities 13.

The housing 6 is preferably a one-piece member made of molded plastic or polymer material. However, in an alternate embodiment the housing could be comprised of multiple members and any suitable materials could be used. The housing 6 comprises a top side with a slot 32 extending into its front end. The housing 6 comprises two of the slide latch ramps 12. The ramps 12 are located on opposite sides of the slot 32. The latch bridge 11 has a front section 34 and a rear section 36. The front section 34 is taller than the rear section 36. The front section 34 is located above the slot 32, the slide latch ramps 12, and guide rails 38 on opposite sides of the slot 32. The rear section 36 of the latch bridge 11 forms a shelf 30 with less space or gap between the interior side of the shelf 30 and the top sides of the guide rails 38.

Figure 7:
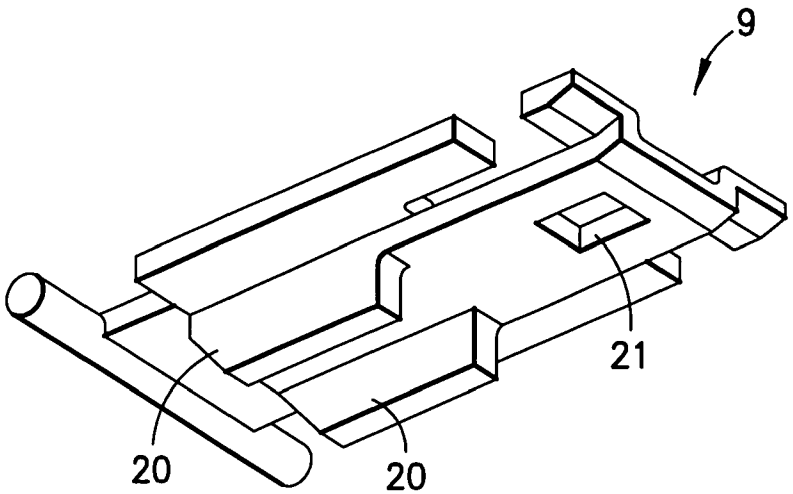
FIG. 7 is a bottom perspective view of the slide latch shown in FIGS. 2 and 3.
Figure 6:
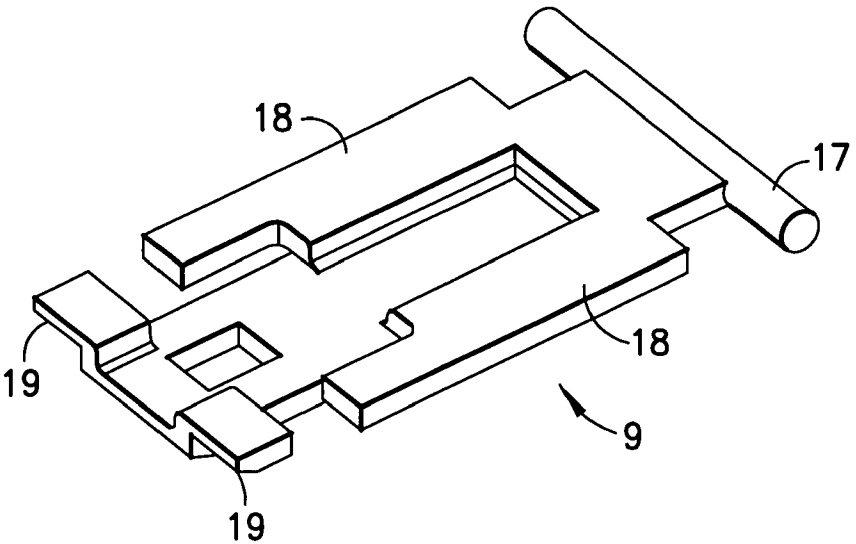
FIG. 6 is a top perspective view of the slide latch shown in FIGS. 2 and 3.

Referring also to FIGS. 6 and 7, the slide latch 9 is preferably a one-piece member made of molded plastic or polymer material. However, in an alternate embodiment the slide latch could be comprised of multiple members and any suitable materials could be used. The slide latch 9 generally comprises a driving bar 17 located near a rear portion of the slide latch 9, guide rails 18 located along lateral side portions of the slide latch 9, latch tabs 19 located near a front portion of the slide latch 9, disconnection rails 20 located along a bottom portion of the slide latch 9, and a lock ramp opening 21 located towards the front portion of the slide latch 9.

Figure 9:
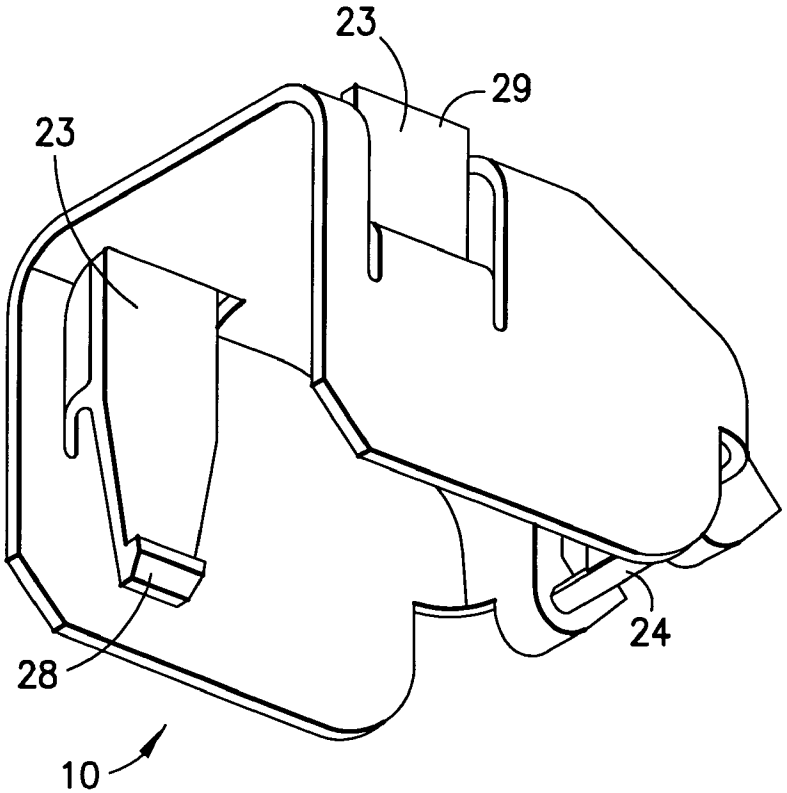
FIGS. 8 and 9 are perspective views of the wire dress cover 10 shown in FIGS. 2 and 3.
Figure 8:
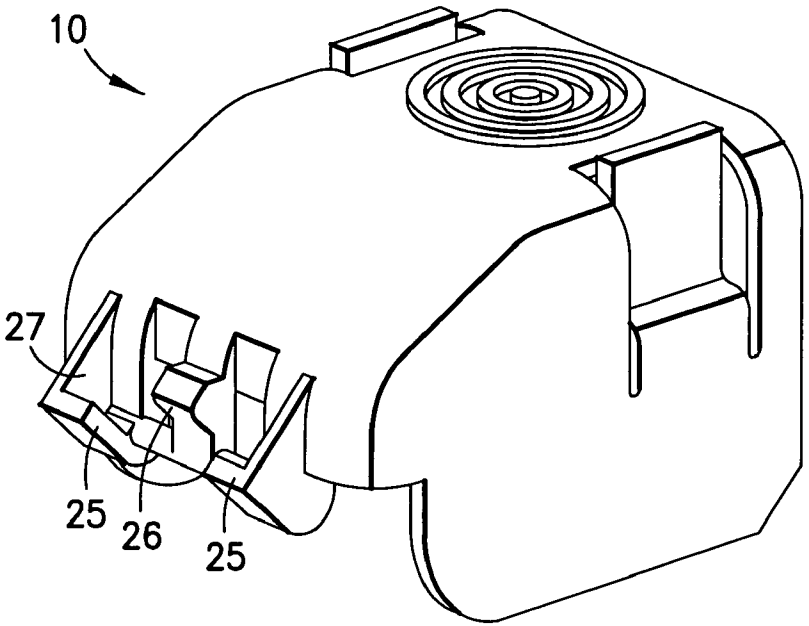

Referring also to FIGS. 8 and 9 the wire dress cover 10 is preferably a one-piece member made of molded plastic or polymer material. However, in an alternate embodiment the wire dress cover could be comprised of multiple members and any suitable materials could be used. The wire dress cover 10 generally comprises an ergonomic actuation surface 22, two wire dress cover latches 23, a pivot bar 24, ramped surfaces 25, 26, and a driving bar reception area 27. The wire dress cover latches 23 each have a cantilevered hook 28 and a cantilevered tab 29. The latches 23 are located on opposite lateral sides of the cover 10.

Figure 10:
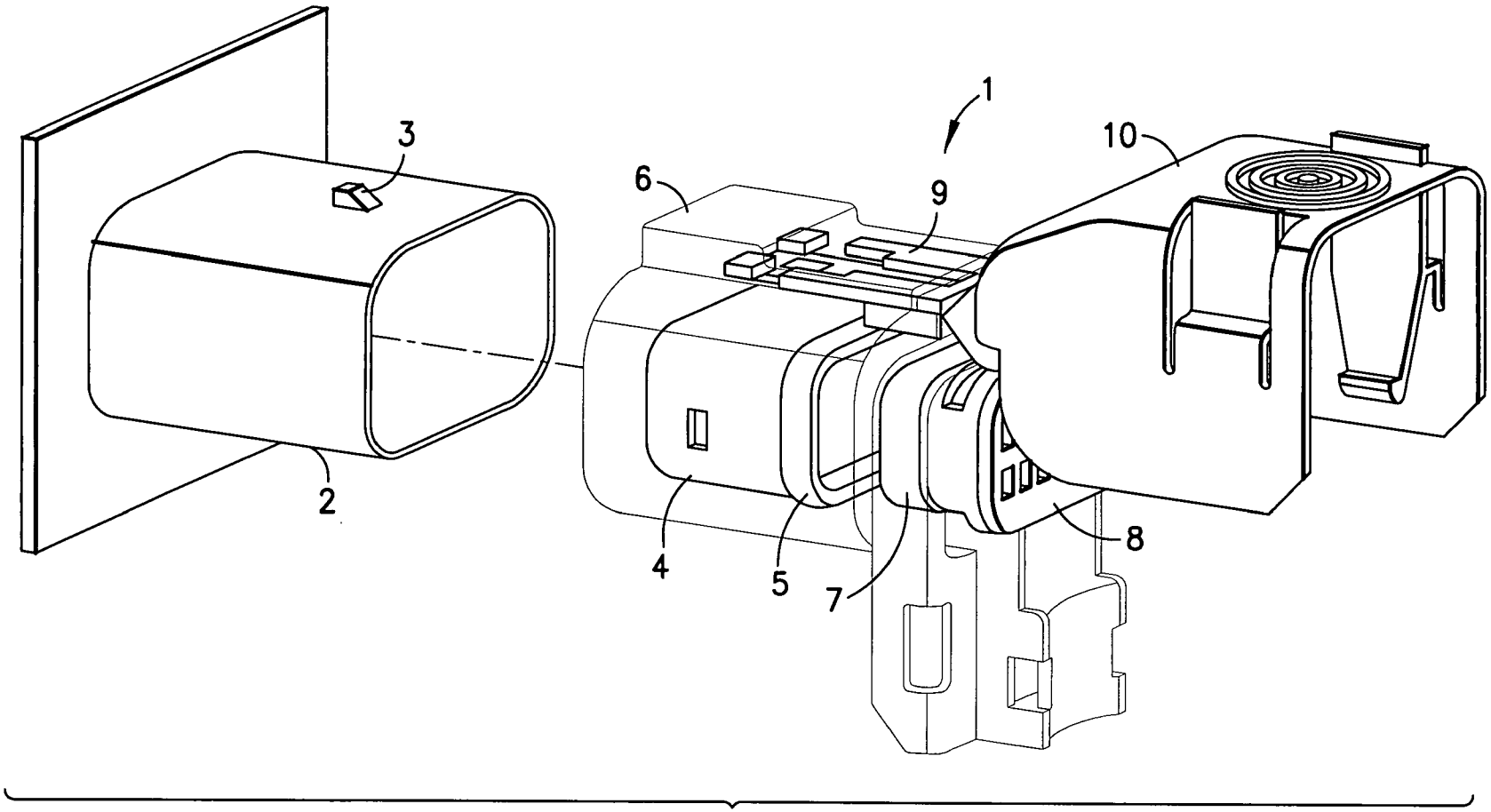
FIG. 10 is a perspective view of the automotive harness connector and mating header connector in an unmated state with the harness connector housing shown in phantom lines.
Figure 11:
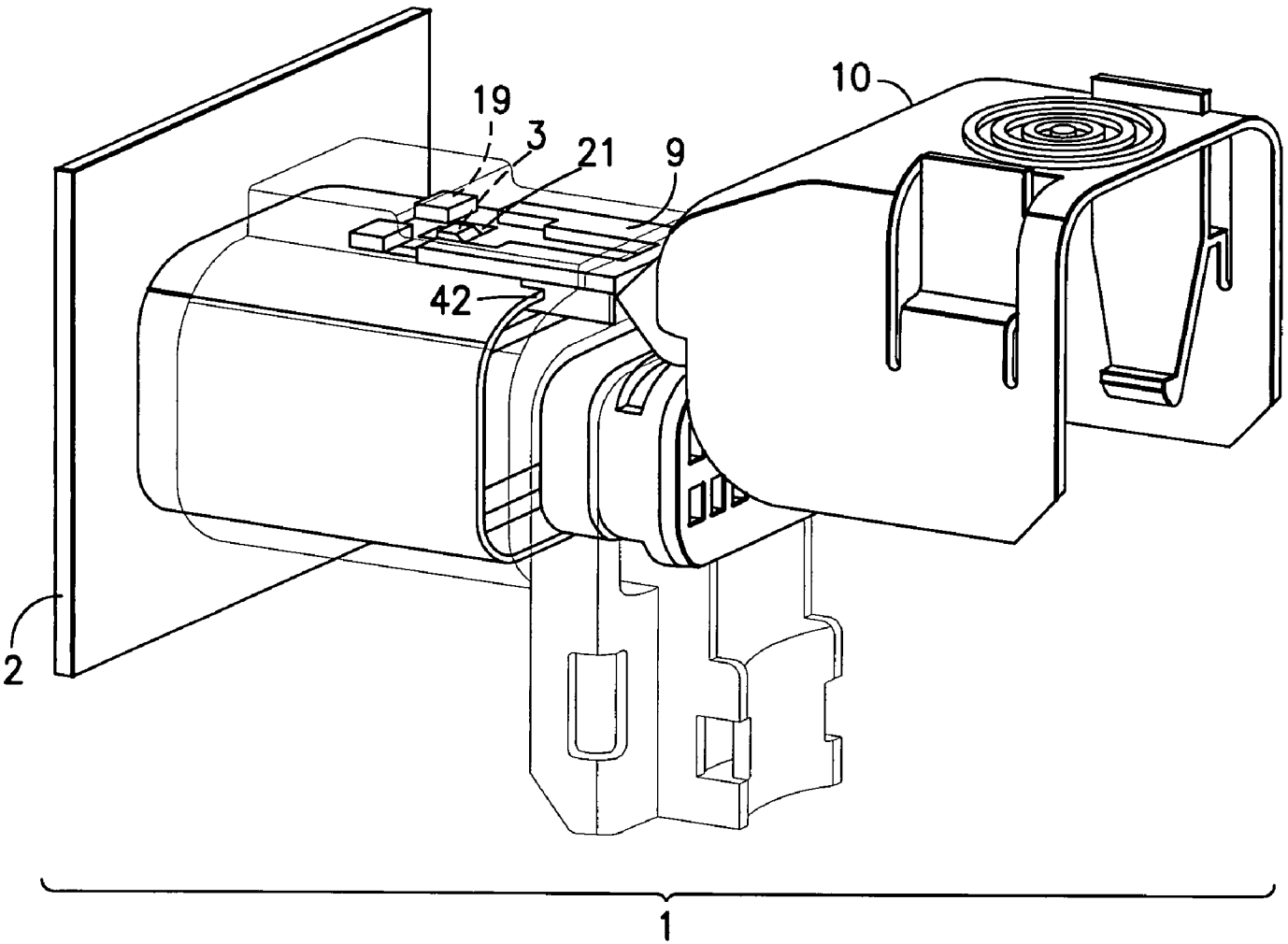
FIG. 11 is a perspective view of the automotive harness connector and mating header connector in a pre-lock state with the harness connector housing shown in phantom lines.

When the connector is initially assembled, the cover 10 is pivotably connected to the housing 6 by the pivot bar 24 and the pivot snaps 15. The cover 10 is initially in an up position as shown in FIGS. 10 and 11. The slide latch 9 is located in the housing 6 with the latch tabs 19 of the slide latch 9 being located under the latch bridge 11 and on top of the guide rails 38. Prior to connector mating, the slide latch 9 is located in a flat intermediate position. In this embodiment the only time the slide latch becomes elevated by the slide latch ramps is during the disconnection sequence when the wire dress cover is lifted; preferably above 90°. However, in alternate embodiments other system workings could be provided. The driving bar 17 of the slide latch 9 extends rearward out of the latch bridge 11 and is connected to the wire dress cover 10 at the driving bar reception area 27.

The wire dress cover 10 can connect to the harness connector housing 6 at two locations. The pivot bar 24 of the wire dress cover 10 snaps into the wire dress cover pivot snaps 15 located at the rear portion of the harness connector housing 6 to form a first pivot-snap connection. The pivot-snap connection enables the wire dress cover 10 to pivot relative to the harness connector housing 6 about the pivot bar 24. The pivot-snap connection, thus, additionally enables the wire dress cover 10 to achieve a plurality of states comprising a pre-lock state and a final lock state, as described below. The second connection can occur when the hooks 28 of the wire dress cover latches 23 engage the wire dress cover latch openings 14 of the harness connector housing 6 to form a second latch connection.

Of the two connections described between the wire dress cover 10 and the harness connector housing 6, the pivot-snap connection is more permanent than the latch connection, although both connections may be reversible (i.e. the wire dress cover 10 may not be permanently and irreversibly attached to the harness connector housing 6). Specifically, the latch connection is releasable. An operator may release the latch connection by pressing the tabs 29 of the wire dress cover latches 23 together, inwards towards the actuation surface 22. This action concurrently moves the hooks 28 outwards and disengages the hooks 28 from the wire dress cover latch openings 14 of the harness connector housing 6, freeing the wire dress cover 10 and enabling it to pivot relative to the harness connector housing 6 about the pivot bar 24.

Figure 14:
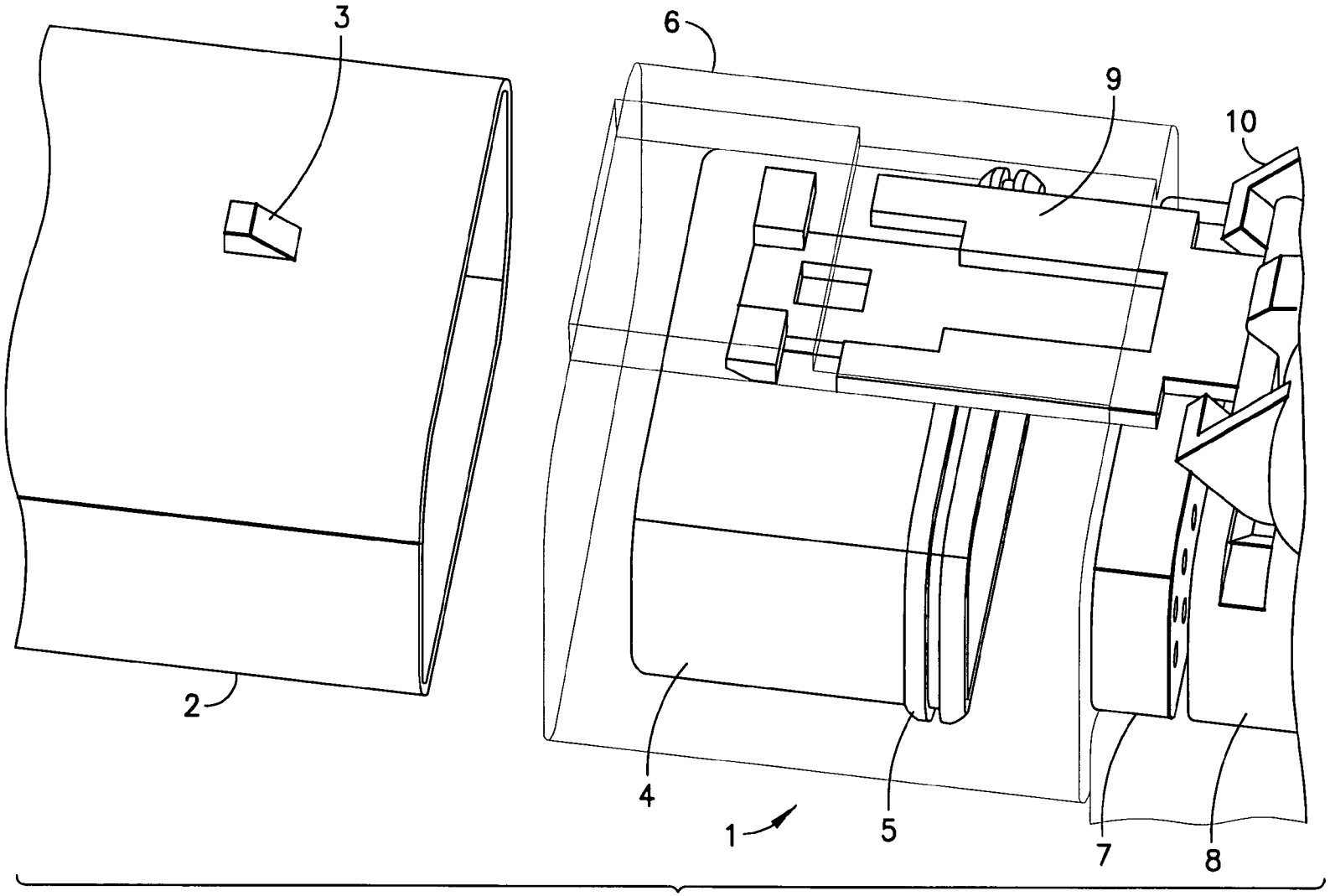
FIG. 14 is a close up perspective view of the latch system of an exemplary embodiment of the invention in the unmated state with the harness connector housing shown in phantom lines.

Referring also to FIGS. 10-12 and 14-16, the harness connector housing 6 is shown in phantom lines such that the interior components of the harness connector housing 6 are visible. FIG. 10 illustrates this more clearly as the TPA 4, perimeter seal 5, mat seal 7 and mat seal cover 8 are all visible and identified. FIGS. 10 and 14 show the connector 1 and the mating header connector 2 in an unmated state where the two connectors are separate. The wire dress cover 10 is in its pre-lock state with the actuation surface 22 of the wire dress cover 10 being substantially parallel to a longitudinal axis of the automotive harness connector 1 and harness connector housing 6. When the wire dress cover 10 is in its pre-lock state, the hooks 28 of the wire dress cover latches 23 are not engaging the wire dress cover latch openings 14 of the harness connector housing 6. Alternate embodiments of the invention may not have the actuation surface 22 of the wire dress cover 10 be substantially parallel to a longitudinal axis of the automotive harness connector 1 and harness connector housing 6 when the wire dress cover 10 is in its pre-lock state. In the unmated state, the slide latch 9 is not yet engaging the lock ramp 3 on the mating header connector 2.

Figure 15:
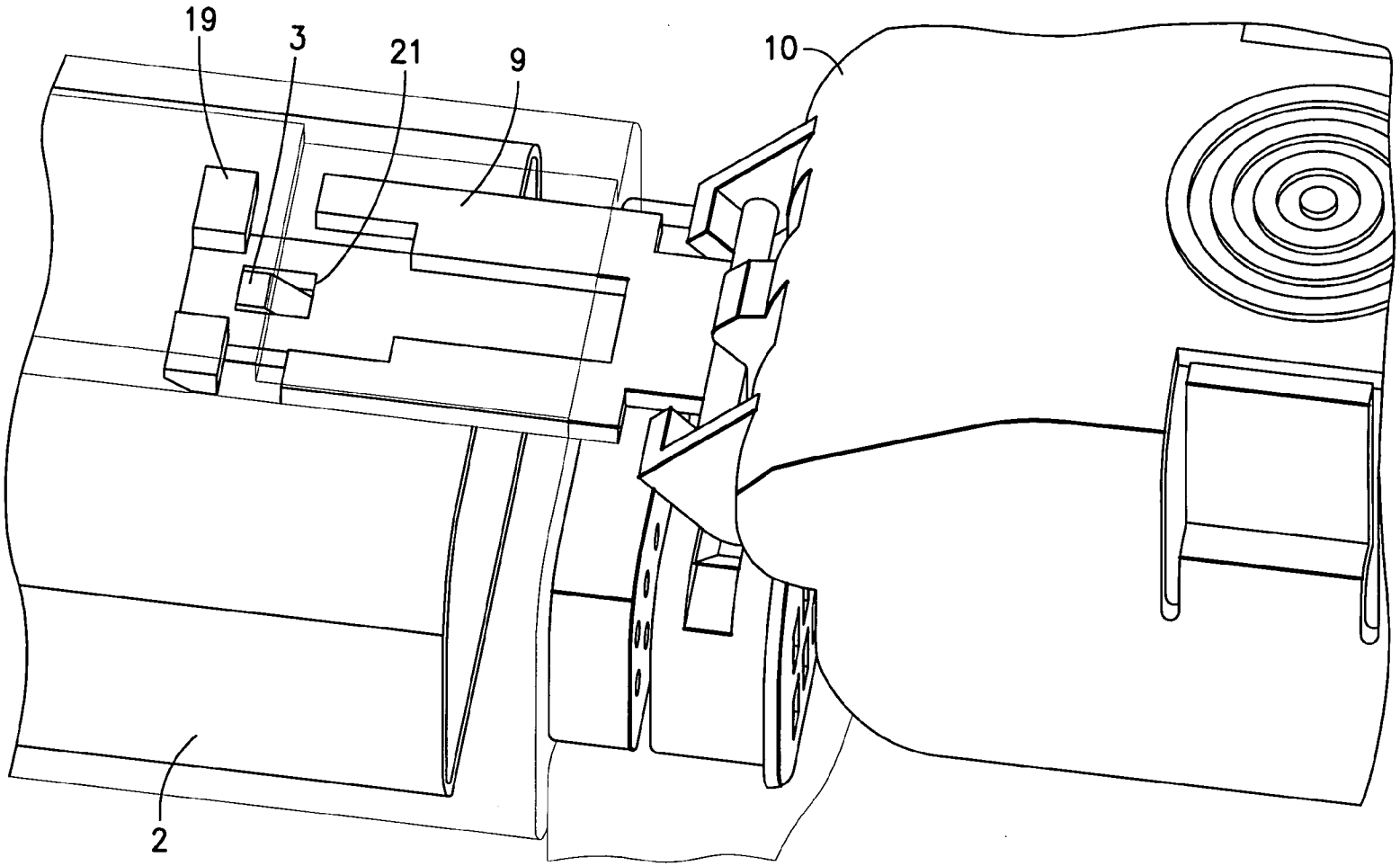
FIG. 15 is a close up perspective view of the latch system of an exemplary embodiment of the invention in the pre-lock state with the harness connector housing shown in phantom lines.

Referring also to FIGS. 11 and 15, the connector 1 and mating header connector 2 are shown in a pre-lock state. In achieving the pre-lock state from the unmated state, the automotive harness connector 1 is pushed onto the mating header connector 2. In so doing, the unrestrained latch tabs 19 of the slide latch 9 allow the front portion of the slide latch 9 to flex upwards, over the lock ramp 3 on the mating header connector 2. The lock ramp 3 is, thus, engaged by the lock ramp opening 21 of the slide latch 9 and the automotive harness connector 1 is initially connected to the mating header connector 2. The wire dress cover 10 remains in its pre-lock state, as described above with respect to FIG. 10. In the pre-lock state, the disconnection rails 20 of the slide latch 9 engage a front lip 42 of the mating header connector 2.

Figure 12:
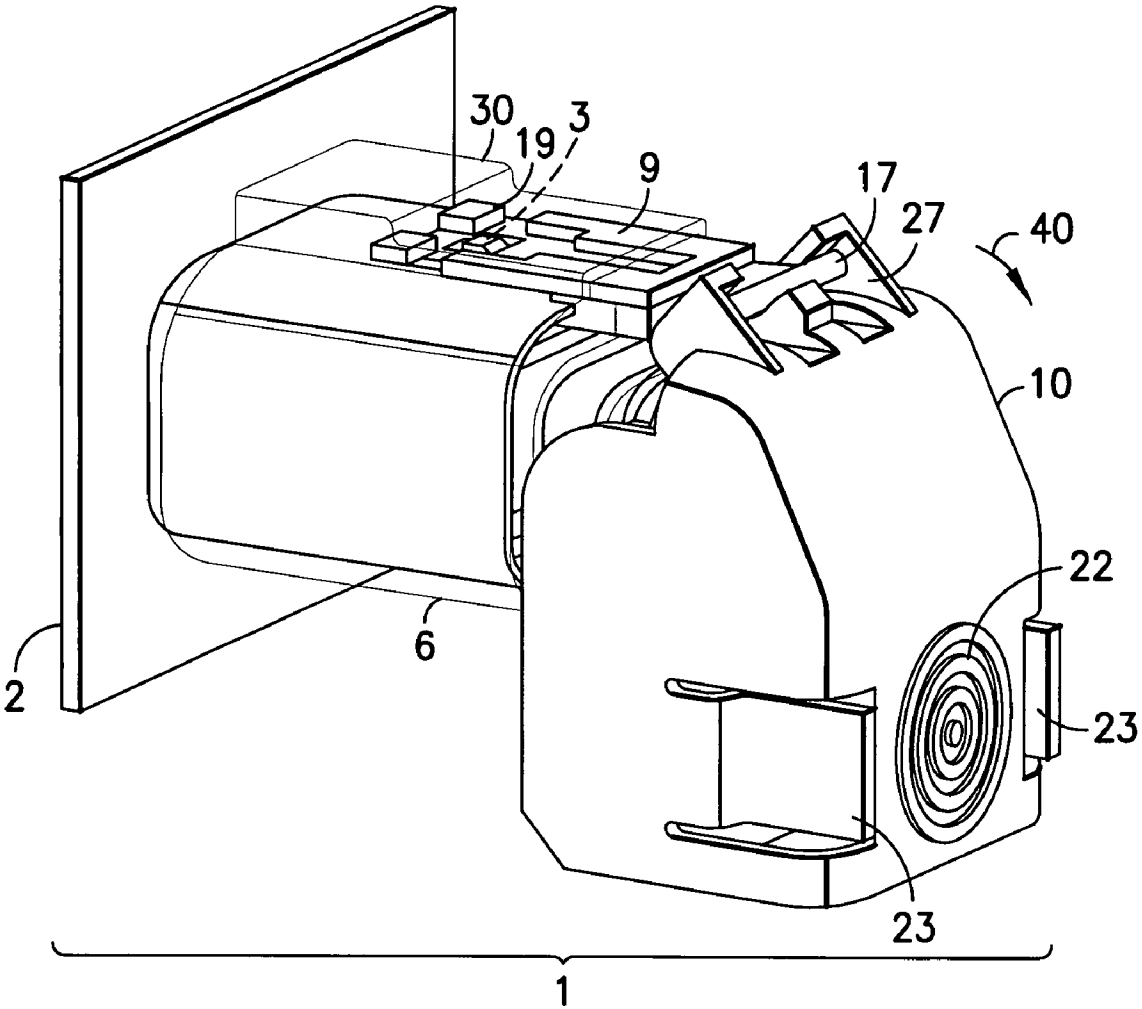
FIG. 12 is a perspective view of the automotive harness connector and mating header connector in a final lock state with the harness connector housing shown in phantom lines.
Figure 16:
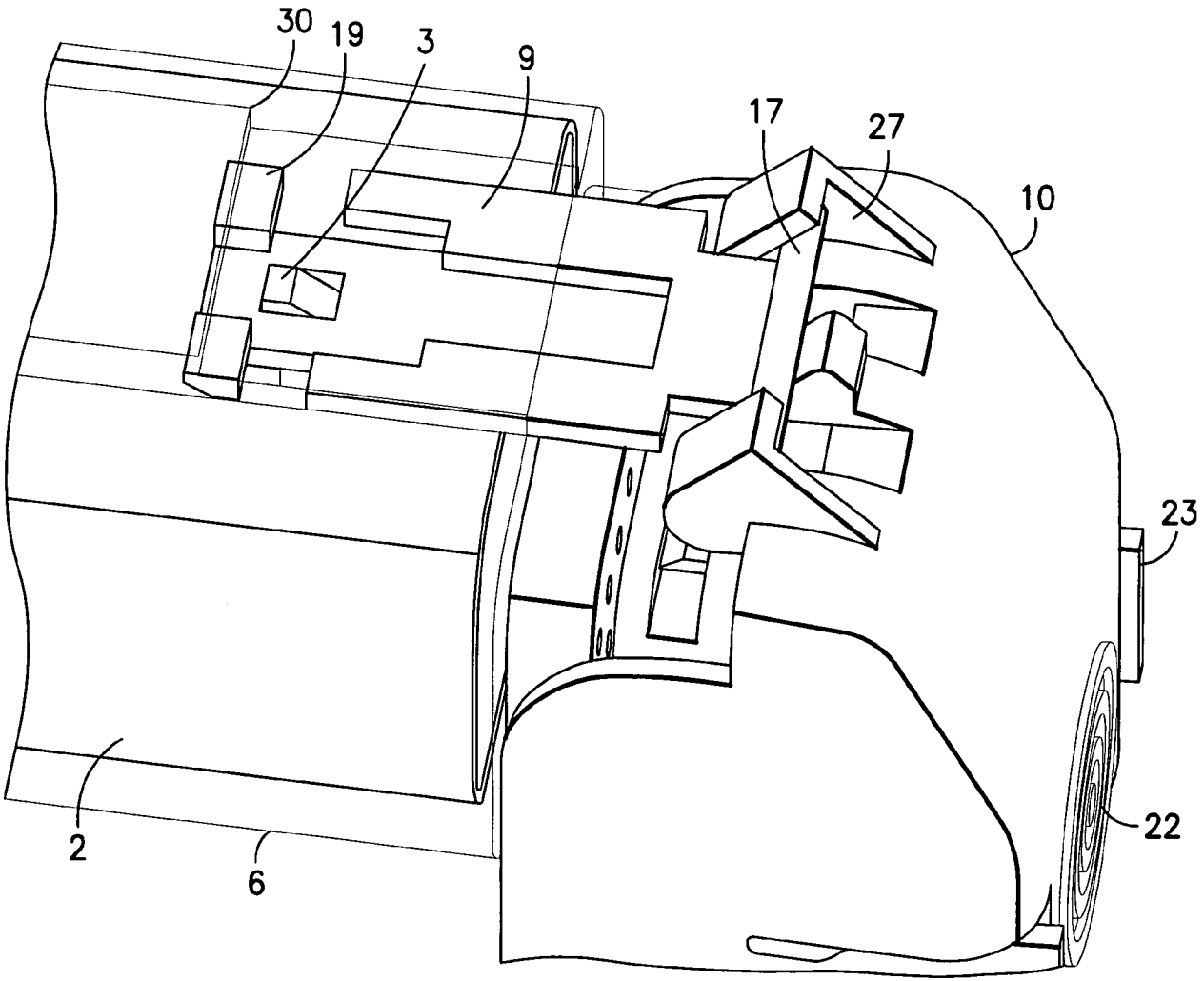
FIG. 16 is a close up perspective view of the latch system of an exemplary embodiment of the invention in the final lock state with the harness connector housing shown in phantom lines.

Referring also to FIGS. 12 and 16, the automotive harness connector 1 and mating header connector 2 are shown in a final lock state. In achieving the final lock state from the pre-lock state, the wire dress cover 10 of the automotive harness connector 1 is pivoted downward, about the pivot bar 24 as indicated by arrow 40, into its final lock state. In its final state the hooks 28 of the wire dress cover latches 23 engage the wire dress cover latch openings 14 of the harness connector housing 6, thus engaging the latch connection described above. The latch connection helps prevent undesired disengagement or release of the two connectors. To pivot the wire dress cover 10 downward, an operator pushes or exerts a force on the actuation surface 22 of the wire dress cover 10.

Figure 13:
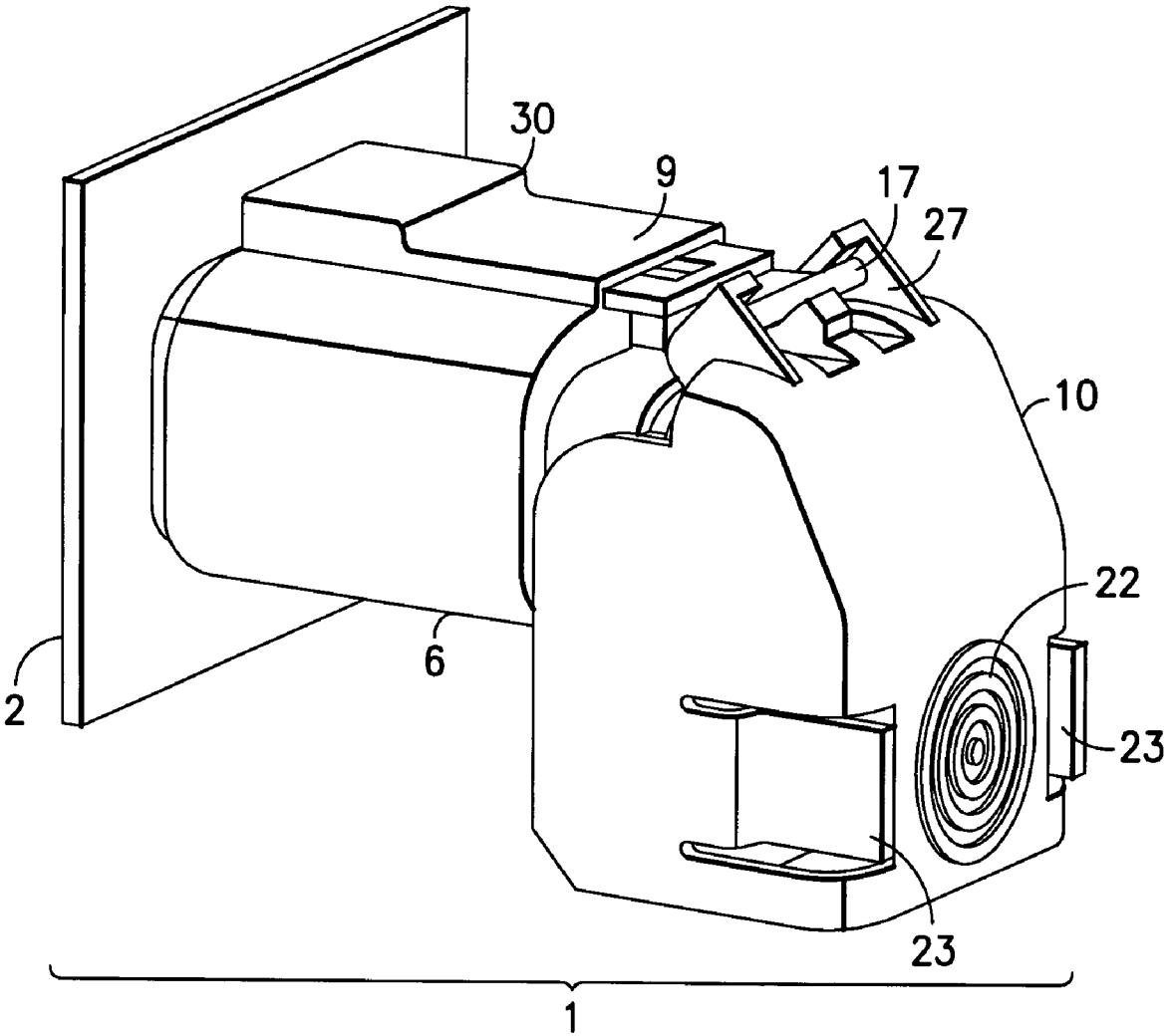
FIG. 13 is a perspective view of the automotive harness connector and mating header connector in the final lock state with the harness connector housing shown normally.

In the final lock state, similar to the pre-lock state, the disconnection rails 20 of the slide latch 9 engage a front lip 42 of the mating header connector 2. The latch tabs 19 of the slide latch 9 engage the shelf 30 on the latch bridge 11 of the harness connector housing 6. The latch tabs 19 are, thus, prevented from moving upward relative to the latch bridge 11. This helps prevent undesired disengagement or release of the two connectors by preventing the opening 21 from moving up and off of the lock ramp 3. In achieving the final lock state, because of the offset pivot axes of connection of the cover 10 to the housing 6 and the latch 9, the wire dress cover 10 pushes the housing 6 (and the terminals therein) deeper into the mating connector 2. The driving bar reception area 27 on the wire dress cover 10 pulls on the driving bar 17 of the slide latch 9, pressing the housing 6 in a direction toward the mating header connector 2. This tensions the slide latch 9 between the lock ramp 3 on the mating header connector 2 and the driving bar's connection to the wire dress cover 10. The ramped surfaces 25, 26 on the wire dress cover 10 assist camming the housing 6 inward due to their contact with the latch 9 and housing 6. Thus, in the final lock state, the automotive harness connector 1 and mating header connector 2 are securely connected, electrically and physically, with various features of the automotive harness connector 1 collectively preventing undesired physical shifting between the two connectors. This also prevents external physical forces from acting upon the internal electrical connection. FIG. 13 is a perspective view of the connector 1 and mating connector 2 in the final lock state with the harness connector housing 6 shown normally (i.e. not in phantom lines).

From the final lock state shown in FIGS. 12, 13 and 16, the connector 1 may be released from its secure connection with the mating connector 2 to disengage and separate the two connectors. To disconnect the two connectors 1, 2, the cover 10 is moved from its closed position to its open position. The latch connection of the cover 10 to the housing 6 is released by pressing on the two opposing tabs 29 of the wire dress cover latches 23. The wire dress cover 10 is then pivoted into its pre-lock state reverse to direction 40 at the pivot bar 24. This releases tension on the slide latch 9. The latch 9 remains substantially stationary relative to the mating connector 2. However, the surfaces 25, 26 of the cover 10 move closer to the mating connector 2. This causes the housing 6 to move away from the mating header connector 2 with the disconnection rails 20 of the slide latch 9 located against the front lip 42 of the mating header connector 2 for support in keeping the slide latch 9 substantially stationary relative to the mating connector 2. The movement of the housing 6 away from the mating connector 2 disconnects the terminals of the connector 1 from the terminals of the connector 2.

As the housing 6 moves away from the mating connector 2, the movement forces the latch tabs 19 of the slide latch 9 to travel up a portion of the slide latch ramps 12 under the latch bridge 11 of the harness connector housing 6. The ramps 12 raise the front portion of the slide latch 9. By raising the front portion of the slide latch 9, the latching connection of the lock ramp 3 of the mating header connector 2 with the lock ramp opening 21 of the slide latch 9 is reduced. Hence, the automotive harness connector 1 can be disconnected from the mating header connector 2 with the slide latch 9 being substantially free to be pulled off the mating header connector 2 and disengage the connection. In such a manner, the two connectors may safely be separated from the final lock state.

Various modifications and adaptations may become apparent to those skilled in the relevant arts in view of the foregoing description, when read in conjunction with the accompanying drawings and the appended claims. Although the wire dress cover-harness connector housing connection is illustrated in the exemplary embodiment above as a snap-pivot connection, alternate embodiments may comprise different types of connections, such as a slideable connection, as a non-limiting example. Alternate embodiments may comprise a different wire dress cover-slide latch connection. Alternate embodiments may comprise different means for the slide latch to connect to the mating header connector, based on the type of connection available in accordance with aspects or features of the mating header connector. Alternate embodiments may not comprise wire dress cover latches. Such alternate embodiments may comprise a different connection mechanism for that wire dress cover-harness connector housing connection. Other alternate embodiments may not comprise any such connection, with the wire dress cover only being connected to the harness connector housing at its movable connection. However, all such and similar modifications of the teachings of this invention will still fall within the scope of this invention.

Furthermore, some of the features of the preferred embodiments of this invention could be used to advantage without the corresponding use of other features. As such, the foregoing description should be considered as merely illustrative of the principles of the present invention, and not in limitation thereof.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector adapted to mate with a mating connector, the electrical connector comprising:

a housing;

a wire dress cover pivotally connected to the housing; and a slide latch pivotally connected to the wire dress cover and slideably connected in or on the housing, wherein the slide latch comprises a front end with a hole sized and shaped to snap lock connect to a lock ramp on the mating connector, and wherein the housing comprises at least one ramp adapted to move the front end of the slide latch relative to the lock ramp in response to the slide latch being slid relative to the housing.

2. The electrical connector of claim 1, wherein the housing comprises a shelf, and wherein the slide latch comprises at least one latch tab for engaging the shelf.

3. The electrical connector of claim 1, wherein the slide latch comprises at least one disconnection rail for engaging a front portion of the mating connector.

4. The electrical connector of claim 3, wherein the housing comprises a shelf, and wherein the slide latch comprises at least one latch tab for engaging the shelf.

5. The electrical connector of claim 1, wherein the electrical connector is an automotive harness connector.

6. The electrical connector of claim 1, wherein the front end of slide latch comprises two cantilevered latch tabs located on opposite sides of the slide latch.

7. The electrical connector of claim 6, wherein latch tabs each comprise a bottom side with a ramp surface.

8. The electrical connector of claim 1, wherein the slide latch comprises two guide rails located on opposite lateral sides of the slide latch, and wherein the housing comprises a latch bridge and two guide rails on opposite sides of a slot under the latch bridge, and wherein the guide rails of the slide latch are adapted to slide along the guide rails of the housing.

9. The electrical connector of claim 1, wherein the slide latch comprises a rear end with a driving bar section.

10. An electrical connector adapted to mate with a mating connector, the electrical connector comprising:

a housing;

a wire dress cover pivotally connected to the housing; and a slide latch pivotally connected to the wire dress cover and slideably connected to the housing, wherein the housing comprises a shelf, and wherein the slide latch comprises at least one latch tab adapted to engage the shelf, wherein the slide latch comprises two guide rails located on opposite lateral sides of the slide latch, and wherein the housing comprises a latch bridge and two guide rails on opposite sides of a slot under the latch bridge, and wherein the guide rails of the slide latch are adapted to slide along the guide rails of the housing.

11. The electrical connector of claim 10, wherein the electrical connector is an automotive harness connector.

12. The electrical connector of claim 10, wherein the slide latch comprises a front end with a hole for snap lock connecting to a lock ramp on the mating connector, and wherein the housing comprises at least one ramp for moving the front end of the slide latch relative to the lock ramp in response to the slide latch being slid relative to the housing.

13. The electrical connector of claim 10, wherein the slide latch comprises at least one disconnection rail for engaging a front portion of the mating connector.

14. The electrical connector of claim 10, wherein the front end of slide latch comprises two of the latch tabs located on opposite sides of the slide latch and extending laterally outward in a general cantilever fashion.

15. The electrical connector of claim 10, wherein the latch tab comprises a bottom side with a ramp surface.

16. The electrical connector of claim 10, wherein the slide latch comprises a rear end with a driving bar section pivotably connected to the wire dress cover.

17. An electrical connector adapted to mate with a mating connector, the electrical connector comprising:

a housing;

a wire dress cover pivotally connected to the housing between an open position and a closed position; and a slide latch pivotally connected to the wire dress cover and slideably connected in or on the housing, wherein the slide latch comprises a front end with a snap-lock latch hole and a second end pivotably connected to the wire dress cover, wherein the snap-lock latch hole is adapted to snap-lock latch with a lock ramp on the mating connector when the wire dress cover is in the open position, and wherein when the wire dress cover is pivoted to the closed position the slide latch is adapted to be substantially stationarily held on the mating connector with the wire dress cover pushing the housing onto the mating connector.

18. The electrical connector of claim 17, wherein the electrical connector is an automotive harness connector.

19. The electrical connector of claim 17, wherein the wire dress cover comprises a snap-lock latch for latching with a portion of the housing at a final lock state of the slide latch.

20. The electrical connector of claim 17 wherein the slide latch comprises at least one disconnection rail adapted to engage an exterior of a front portion of the mating connector.

* * * * *